US008931145B1

(12) United States Patent
Liao

(10) Patent No.: US 8,931,145 B1
(45) Date of Patent: Jan. 13, 2015

(54) SLIDING ZIPPER CONTROLLER

(71) Applicant: Mei-Lee Liao, Taipei (TW)

(72) Inventor: Mei-Lee Liao, Taipei (TW)

( * ) Notice: Subject to any disclaimer, the term of this patent is extended or adjusted under 35 U.S.C. 154(b) by 0 days.

(21) Appl. No.: 14/085,186

(22) Filed: Nov. 20, 2013

(51) Int. Cl.
*A44B 19/26* (2006.01)

(52) U.S. Cl.
CPC ..... *A44B 19/262* (2013.01)
USPC ..... 24/429

(58) Field of Classification Search
CPC ..... A44B 19/262
USPC ..... 24/429, 431
See application file for complete search history.

(56) References Cited

U.S. PATENT DOCUMENTS

| | | | | |
|---|---|---|---|---|
| 4,389,758 | A * | 6/1983 | Akashi | 24/429 |
| 4,512,064 | A * | 4/1985 | Nishikawa | 24/429 |
| 5,860,192 | A * | 1/1999 | Chung | 24/429 |
| 6,035,497 | A * | 3/2000 | Jackson | 24/429 |
| 6,804,867 | B2 * | 10/2004 | Oda et al. | 24/429 |
| 7,117,567 | B1 * | 10/2006 | Krulik et al. | 24/429 |
| 7,574,783 | B2 * | 8/2009 | Muratsubaki et al. | 24/429 |
| 2002/0069494 | A1 * | 6/2002 | McCrum | 24/429 |

* cited by examiner

*Primary Examiner* — Victor Batson
*Assistant Examiner* — Abigail Morrell
(74) *Attorney, Agent, or Firm* — Egbert Law Offices, PLLC

(57) ABSTRACT

A sliding controller for a zipper has a slider, a close-ended connecting rack, a U-shaped connecting sheet, an elastic plastic tab and at least three embedded through-holes. The zipper's sliding controller features lower manufacturing cost, resistance to rust, stronger robustness and longer service life.

3 Claims, 3 Drawing Sheets

SLIDING ZIPPER CONTROLLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a partial structure of a zipper, and more particularly to an innovative one which is designed with a sliding controller having a slider and a tab.

2. Description of Related Art Including Information Disclosed Under 37 CFR 1.97 and 37 CFR 1.98

A zipper refers to a strip-type fastener that can be opened or closed alternatively. They are widely applied to bags, clothing, luggage and backpacks, due to unique advantages including ease of operation.

The zipper structurally comprises a strip-type, toothed zipper strap and a sliding controller for controlling the toothed state of the zipper strap. Of which, the sliding controller comprises a slider and a tab. The present invention is intended for discussing said sliding controller.

The following shortcomings of typical zipper's sliding controller are still observed during actual applications.

First, the tab of typical sliding controller is generally made of metal materials, so the manufacturing cost of a zipper increases markedly due to growing cost of metal materials. In terms of application, said tab is exposed outside of the product, so the metal material is vulnerable to moisture and rustiness, leading to breakage and damage during pulling process.

Second, the tab and slider of typical sliding controller are assembled in such a manner that a through-hole set at end of the tab is often sleeved into a hook-shaped seat protruded at the surface of the slider. In order to prevent reverse disengagement of the tab from the opening of the hook-shaped seat, the hook-shaped seat must be pressed to reduce the gap of the opening after assembly of the tab and hook-shaped seat. In such a case, the structure and strength of the hook-shaped seat may be compromised against its robustness and durability.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the structural configuration and technical characteristics of the present invention wherein "the sliding controller of zipper" mainly comprises a slider, a close-ended connecting rack, a U-shaped connecting sheet, an elastic plastic tab and at least three embedded through-holes, the zipper's sliding controller of the present invention features lower manufacturing cost, resistance to rustiness, stronger robustness and longer service life.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
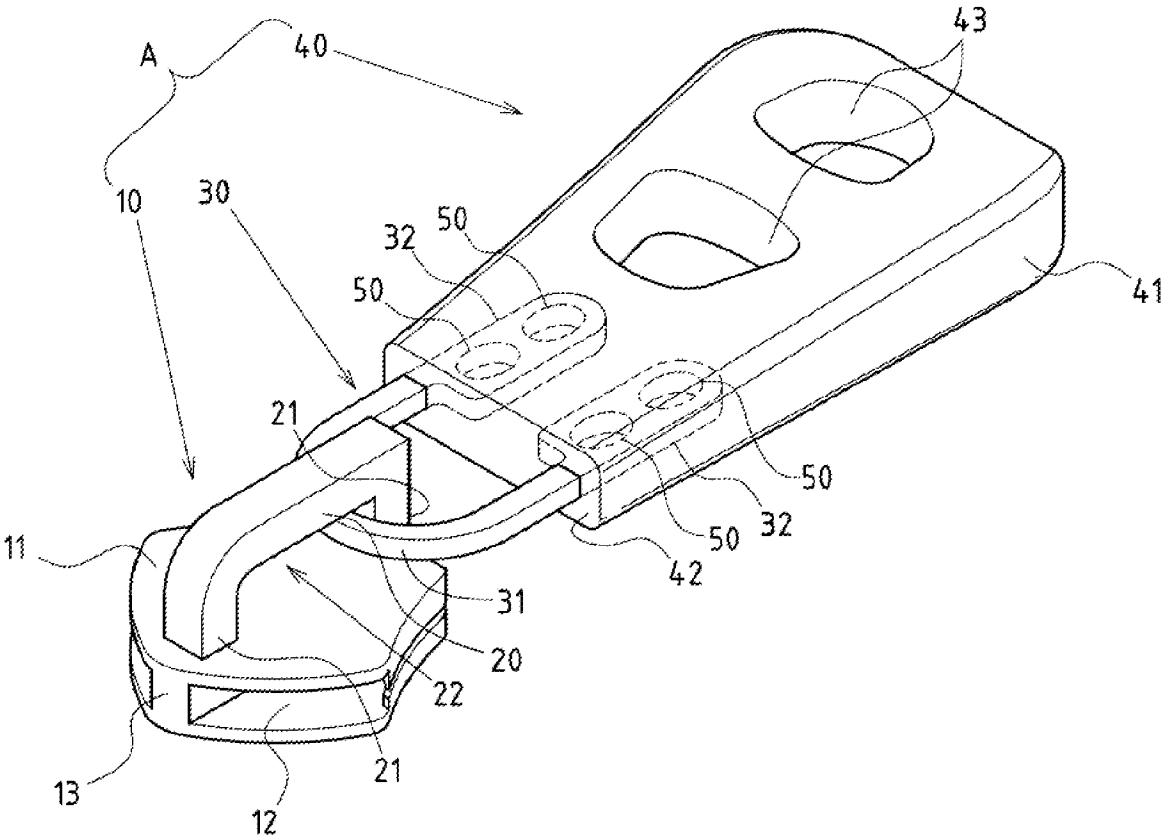
FIG. 1 is an assembled perspective view of the preferred embodiment of the sliding controller of the present invention.
Figure 2:
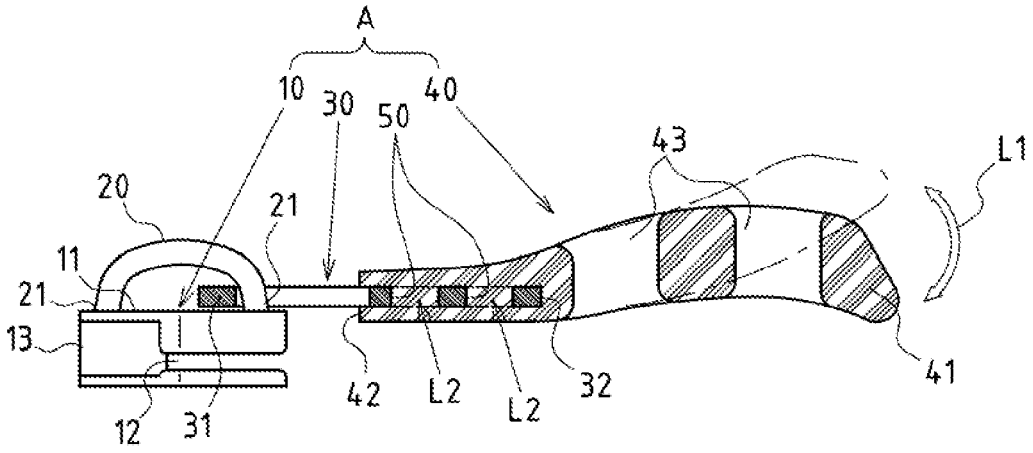
FIG. 2 is a first lateral sectional view of the preferred embodiment of the sliding controller of the present invention.
Figure 3:
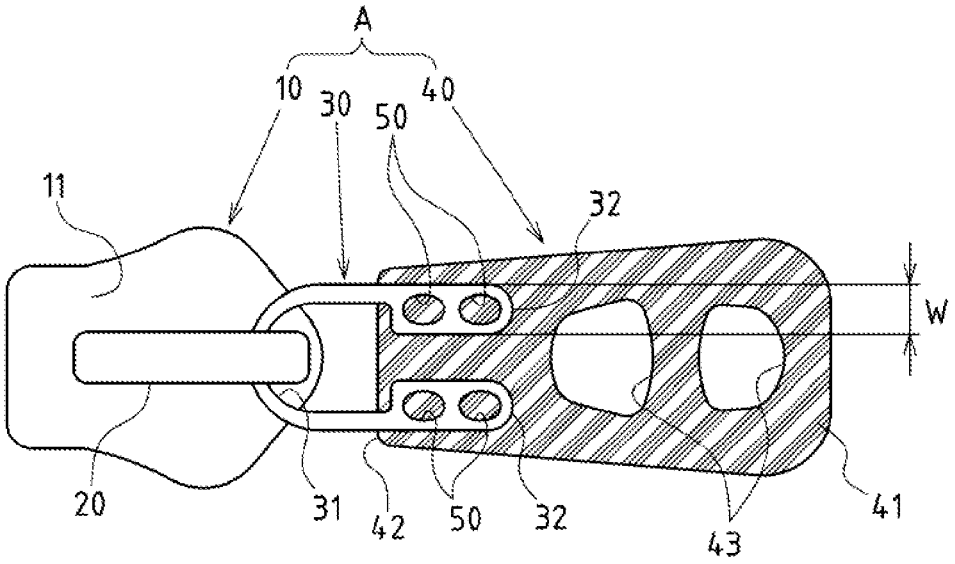
FIG. 3 is a second lateral sectional view of the preferred embodiment of the sliding controller of the present invention.

FIGS. 1-3 depict preferred embodiments of the zipper's sliding controller of the present invention, which, however, are provided for only explanatory objective;. Said sliding controller A comprises a slider 10, formed into a seating structure made of metal or solid plastics. Said slider 10 comprises of an external surface 11, a zipper strap groove 12 and a separation rib 13 set at middle of the zipper strap groove 12.

A close-ended connecting rack 20 is protruded outside the external surface 11 of the slider 10. Said close-ended connecting rack 20 comprises of two ends 21 set at interval in an arched state. Two ends 21 are linked integrally to the external surface 11 of the slider 10, so a steel sheet buckling portion 22 is formed between the close-ended connecting rack 20 and the external surface 11 of the slider 10.

A U-shaped connecting sheet 30 is provided and is made of steel and designed into a "U" shape. The U-shaped connecting sheet 30 comprises of a folding portion 31 and two connecting ends 32. Of which, the folding portion 31 penetrates the steel sheet buckling portion 22.

An elastic plastic tab 40 is made of elastic plastics featuring stress bending and automatic recovery (marked by arrow L1 in FIG. 2). Said elastic plastic tab 40 comprises of a pulling end 41 and a coupling end 42. Of which, the coupling end 42 is covered onto two connecting ends 32 of the U-shaped connecting sheet 30 by means of ejection molding.

At least three embedded through-holes 50 are set separately at two connecting ends 32 of the U-shaped connecting sheet 30. Said embedded through-links 50 are perforated such that the plastic structure in the coupling end 42 of the elastic plastic tab 40 can be embedded into the embedded through-holes 50 (marked by L2 in FIG. 2), and the elastic plastic tab 40 can be mated securely with the U-shaped connecting sheet 30.

Of which, the embedded through-holes 50 are set onto two connecting ends 32 of the U-shaped connecting sheet 30 with expanded width (marked by W in FIG. 3).

Referring to FIGS. 1 and 3, four embedded through-holes 50 can be separately arranged at two connecting ends 32 of the U-shaped connecting sheet 30 in two pairs.

Referring to FIGS. 1-3, at least a through-portion 43 is set at the pulling end 41 of the elastic plastic tab 40.

Figure 4:
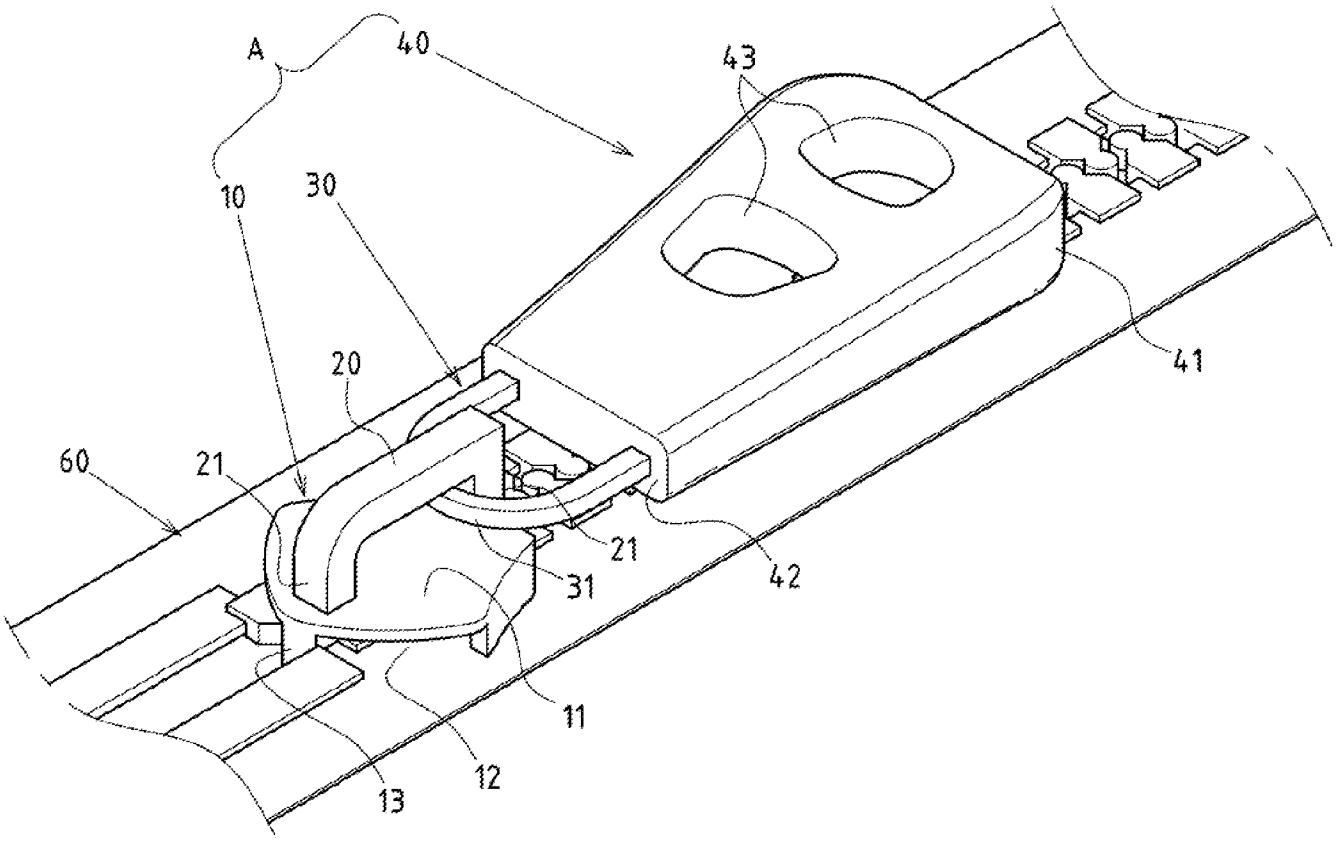
FIG. 4 is an application view of the present invention wherein the sliding controller and zipper strap form an integral zipper.

Referring to FIG. 3, said embedded through-holes 50 are of an elliptical pattern as a preferred embodiment, since said elliptical embedded through-holes 50 allow to expand the aperture in tune with the elongated shape of the elastic plastic tab 40, thus obtaining a bigger embedding space for the plastic structure with better effect Based on above-specified structural design, said sliding controller A of the present invention is operated in a way that, as shown in FIG. 4, a zipper strap 60 passes through the zipper strap groove 12 of the slider 10 to form an integral zipper product. As for the manufacturing of said sliding controller A of the present invention, the folding portion 31 of the U-shaped connecting sheet 30 is allowed to pass through the external steel sheet buckling portion 22 formed between the close-ended connecting rack 20 and the external surface 11 of the slider 10, then the elastic plastic tab 40 is covered onto two connecting ends 32 of the U-shaped connecting sheet 30 by a plastics ejection molding device. In such a case, the plastic structure inside the coupling end 42 of the elastic plastic tab 40 could be separately embedded into various embedded through-holes 50 of these two connecting ends 32 of the U-shaped connecting sheet 40 (indicated by arrow L2 in FIG. 2), so that the elastic plastic tab 40 and U-shaped connecting sheet 30 can be fastened securely. Since at least four embedded through-holes 50 are arranged in two pairs, the coupling strength could be multiplied; and the folding portion 31 of the U-shaped connecting sheet 30 passes through the external steel sheet buckling portion 22 formed by the close-ended connecting rack 20, so the problem of disengagement of conventional tab from one opening side could be resolved; as for the manufacturing cost, the elastic plastic tab 40 of the present invention could replace conventional metal tab, thus reducing remarkably the material cost of the zipper's sliding controller. Meanwhile the elastic plastic tab 40 could be used more robustly due to absence of metal rustiness.

I claim:

1. A sliding controller apparatus for a zipper, the sliding controller apparatus comprising:

a slider formed into a seating structure, said seating structure formed of metal or polymeric material, said slider having an external surface and a zipper strap groove and a separation rib, said separation rib positioned at a middle of said zipper strap groove;

a close-ended connecting rack protruded outwardly of said external surface of said slider, said close-ended connecting rack comprising a pair of ends spaced from each other and configured into an arched configuration, said pair of ends linked to said external surface of said slider, said close-ended connecting rack and said external surface of said slider having a steel sheet buckling portion formed therebetween;

a U-shaped connecting sheet formed of steel, said U-shaped connecting sheet having a folding portion and a pair of connecting ends, said folding portion penetrating said steel sheet buckling portion;

an elastic plastic tab having a pulling end and a coupling end, said coupling end covering said pair of connecting ends of said U-shaped connecting sheet; and at least three embedded through-holes positioned separately at an expanded width portion of said pair of connecting ends of said U-shaped connecting sheet, the embedded through-holes being perforated such that said elastic plastic tab is embedded into the embedded through-holes, said elastic plastic tab matable securely with said U-shaped connecting sheet.

2. The sliding controller apparatus of claim 1, said at least three embedded through-holes comprising four embedded through-holes separately arranged in pairs respectively of said connecting sheet ends of said U-shaped connecting sheet.

3. The sliding controller apparatus of claim 1, the embedded through-holes having an elliptical shape.

* * * * *